US010194732B2

(12) United States Patent
Sagan

(10) Patent No.: US 10,194,732 B2
(45) Date of Patent: Feb. 5, 2019

(54) COMPRESSIBLE RUNNING BAG

(71) Applicant: NIKE, Inc., Beaverton, OR (US)

(72) Inventor: David Sagan, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 495 days.

(21) Appl. No.: 14/955,795

(22) Filed: Dec. 1, 2015

(65) Prior Publication Data

US 2016/0150870 A1 Jun. 2, 2016

Related U.S. Application Data

(60) Provisional application No. 62/086,183, filed on Dec. 1, 2014.

(51) Int. Cl.

| | |
|---|---|
| ***A45F 3/04*** | (2006.01) |
| ***A45F 3/02*** | (2006.01) |
| ***A45C 7/00*** | (2006.01) |

(52) U.S. Cl.

CPC ..... *A45F 3/04* (2013.01); *A45C 7/0072* (2013.01); *A45F 3/02* (2013.01)

(58) Field of Classification Search

CPC ..... A45F 3/04; A45C 7/0063; A45C 3/04
USPC ..... 224/607; 383/2
See application file for complete search history.

(56) References Cited

U.S. PATENT DOCUMENTS

| | | | | | |
|---|---|---|---|---|---|
| 2,454,013 | A * | 11/1948 | Scherzinger | B65D 33/12 | 383/16 |
| 2,729,257 | A * | 1/1956 | Kepper | A45C 7/0068 | 383/121 |
| 3,229,741 | A * | 1/1966 | Ambrose | A45C 7/0072 | 383/12 |
| 3,746,066 | A * | 7/1973 | McIntyre | A45C 7/0063 | 150/107 |
| 4,273,274 | A * | 6/1981 | Freistadt | A45F 3/04 | 150/108 |
| 5,490,619 | A * | 2/1996 | Boyar | A45C 7/0077 | 150/103 |
| 6,419,135 | B1 * | 7/2002 | Sali | A45C 7/0063 | 224/610 |
| 6,435,391 | B1 * | 8/2002 | Vazquez | A45C 13/1046 | 224/613 |
| 6,830,170 | B2 * | 12/2004 | Abel | A01M 31/006 | 190/107 |
| 7,073,942 | B2 * | 7/2006 | Vazquez | A45C 7/0063 | 190/103 |

(Continued)

FOREIGN PATENT DOCUMENTS

| | | | |
|---|---|---|---|
| CH | 415985 | A | 6/1966 |
| CN | 2572823 | Y | 9/2003 |

(Continued)

OTHER PUBLICATIONS

International Search Report and Written Opinion dated May 24, 2016 in International Patent Application No. PCT/US2015/063159, 10 pages.

(Continued)

*Primary Examiner* — Nathan J Newhouse
*Assistant Examiner* — Lester L Vanterpool
(74) *Attorney, Agent, or Firm* — Shook, Hardy & Bacon L.L.P.

(57) ABSTRACT

Present aspects hereof are directed to a compressible backpack having a plurality of compressible flanges that shift along a vertical axis of the compressible bag upon tensioning of at least one bag tether. In some aspects, a locking mechanism restricts travel of the bag tethers in a first direction, while permitting travel in a second direction upon triggering a locking release.

20 Claims, 8 Drawing Sheets

(56) References Cited

U.S. PATENT DOCUMENTS

| | | | | |
|---|---|---|---|---|
| 7,909,150 | B2 * | 3/2011 | Mangano | A45C 3/06 150/103 |
| 8,092,087 | B2 * | 1/2012 | Simhony | A45C 13/30 150/108 |
| 2001/0031104 | A1 * | 10/2001 | Vazquez | A45C 7/0063 383/2 |
| 2006/0262996 | A1 * | 11/2006 | Vazquez | A45C 7/0063 383/2 |
| 2007/0241145 | A1 * | 10/2007 | Williams | A45C 7/0077 224/148.7 |
| 2010/0284631 | A1 * | 11/2010 | Lee | A45C 3/06 383/12 |
| 2011/0255805 | A1 * | 10/2011 | Wang | A45C 7/0077 383/26 |

FOREIGN PATENT DOCUMENTS

| | | | |
|---|---|---|---|
| CN | 201200053 | Y | 3/2009 |
| CN | 201831132 | U | 5/2011 |
| FR | 1557297 | A | 2/1969 |
| FR | 2738128 | A1 | 3/1997 |
| FR | 2738128 | A1 | 3/1997 |
| FR | 2940249 | A1 | 6/2010 |

OTHER PUBLICATIONS

International Preliminary Report on Patentability dated Jun. 15, 2017 in International Patent Application No. PCT/US2015/063159, 8 pages.

* cited by examiner

COMPRESSIBLE RUNNING BAG

CROSS-REFERENCE TO RELATED APPLICATIONS

This application claims priority to U.S. Provisional Patent Application No. 62/086,183, filed Dec. 1, 2014, entitled "Compressible Running Bag," the entire content of which is hereby incorporated by reference.

STATEMENT REGARDING FEDERALLY SPONSORED RESEARCH OR DEVELOPMENT

Not applicable.

TECHNICAL FIELD

Present aspects hereof relate to a compressible backpack. More specifically, exemplary aspects relate to a backpack having a central body with multiple segments that are moveable between an expanded position and a compressed position. Further aspects relate to a method of making a compressible backpack having multiple sections that are seated within adjacent sections to compress or expand along a vertical axis of the backpack.

BACKGROUND

Portability and compactness of athletic attire and equipment may be optimized by the use of particular materials or configurations of construction. Additionally, an item of athletic equipment may become more useful when the same piece of equipment provides multiple desired features, without the need to carry additional equipment.

SUMMARY

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter. Present aspects hereof are defined by the claims.

Present aspects hereof are directed toward a compressible backpack having a central body comprising a bottom portion and at least one upper portion moveable relative to the bottom portion. The compressible backpack includes a first channel, a second channel, a third channel, and a fourth channel, wherein each of the first, second, third, and fourth channels comprises at least one aperture in the at least one upper portion. Additionally, a first tether is disposed within at least a portion of the first channel and at least a portion of the second channel, said first tether coupled to a first pair of anchors associated with the first and second channels. A second tether is disposed within at least a portion of the first channel, at least a portion of the second channel, at least a portion of a third channel, and at least a portion of a fourth channel, said second tether coupled to a second pair of anchors associated with the third and fourth channels. In some aspects, a pair of control mechanisms are coupled to a control release, said control mechanism configured to engage at least a portion of the first and second tethers In one exemplary aspect, a compressible bag includes an upper bag portion, a lower bag portion, and an intermediate bag portion. In aspects, the intermediate bag portion includes a plurality of compressible segments each having a flange and a cavity, said plurality of compressible segments comprising: a lower compressible segment adjacent said lower bag portion, an upper compressible segment adjacent said upper bag portion, a first channel comprising at least one aperture in at least one compressible segment of the plurality of compressible segments, and a second channel comprising at least one aperture in at least one compressible segment of the plurality of compressible segments. Additionally, the compressible bag includes at least one tether coupled to the lower bag portion, said at least one tether disposed within at least a portion of the first channel and at least a portion of the second channel; and at least one locking mechanism configured to engage the at least one tether, wherein when the bag is in an expanded position, the lower compressible segment is separated a first distance from the upper compressible segment, wherein when the bag is in a compressed position, the lower compressible segment is separated a second distance from the upper compressible segment, wherein the second distance is less than the first distance.

In further aspects, a compressible bag includes a bottom bag segment; a central bag segment adjacent the bottom bag segment, said central bag segment aligned along a vertical axis and comprising an interior bag cavity; a plurality of compressible bag flanges coupled to at least a portion of a circumference of the central bag segment, wherein each of the plurality of compressible bag flanges comprises a cavity between a bottom edge of each of the compressible bag flanges and the central bag segment; a first channel comprising at least one aperture in at least one of the plurality of compressible bag flanges; a second channel comprising at least one aperture in at least one of the plurality of compressible bag flanges; a first tether disposed within the first channel at a first end of the first tether, and disposed within the second channel at a second end of the first tether, wherein the first tether is coupled to a back side of the compressible bag; a second tether disposed within the first channel at a first end of the second tether, and disposed within the second channel at a second end of the second tether, wherein the second tether is coupled to a front side of the compressible bag; and a control mechanism coupled to the first tether and the second tether, wherein the control mechanism is configured to secure the compressible bag in a compressed position based on tensioning the first and second tethers.

Additional features of exemplary aspects are described below.

BRIEF DESCRIPTION OF THE DRAWINGS

Examples are described in detail below with reference to the attached drawing figures, wherein.

DETAILED DESCRIPTION

Figure 1:
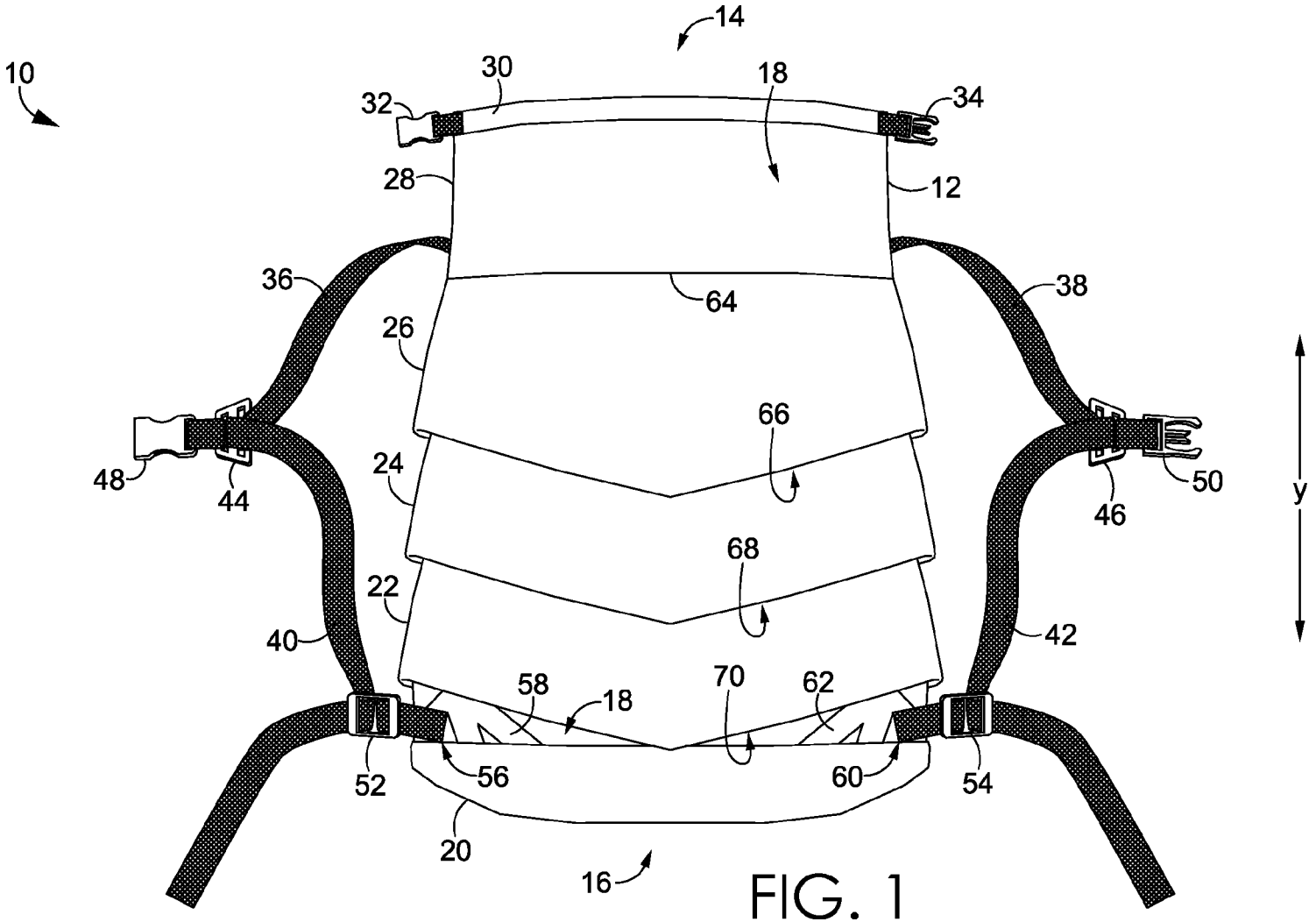
FIG. 1 depicts a front view of a compressible bag in an expanded position, in accordance with an example of present aspects.
Figure 2:
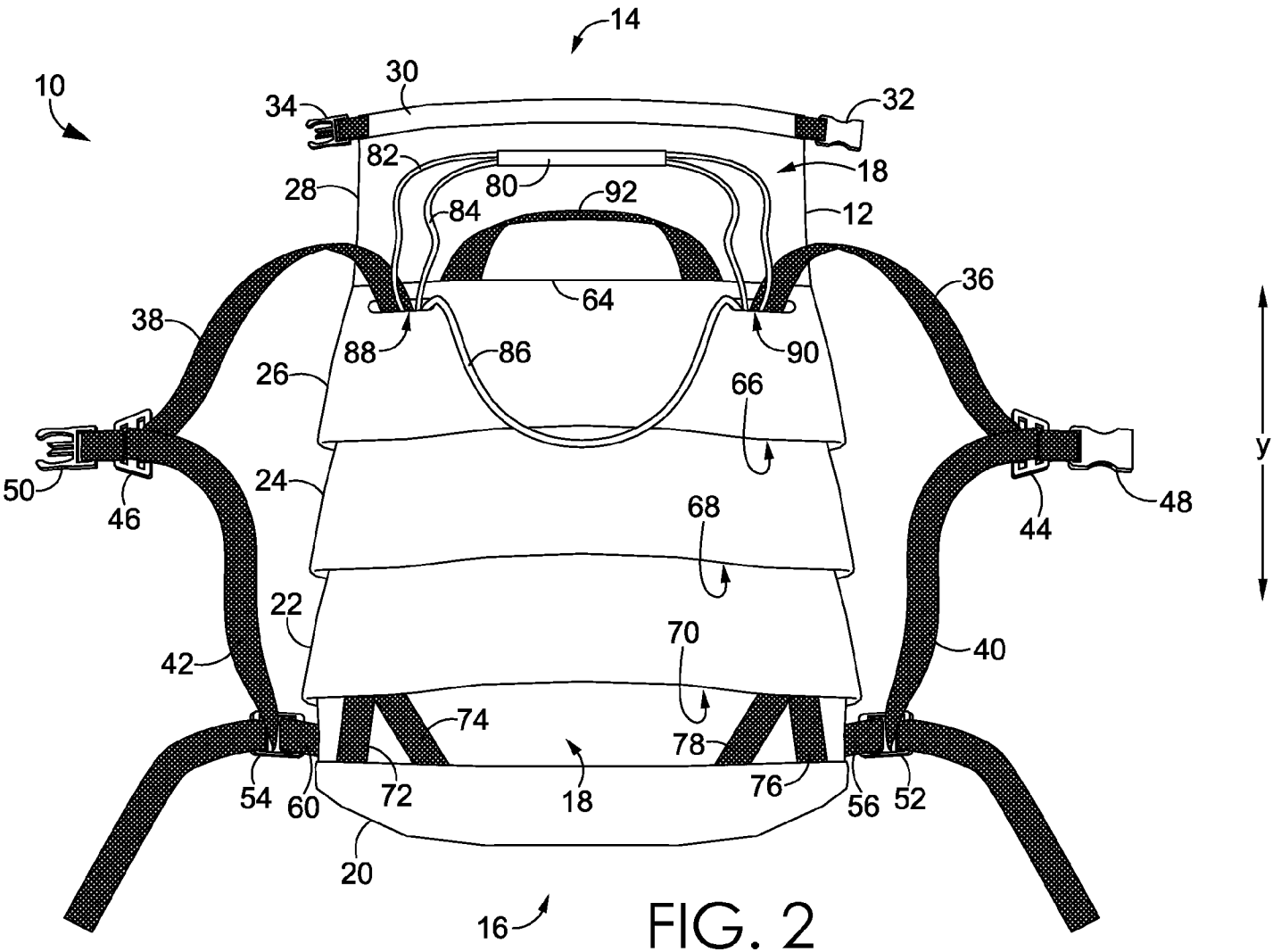
FIG. 2 depicts a back view of the compressible bag depicted in FIG. 1.
Figure 3:
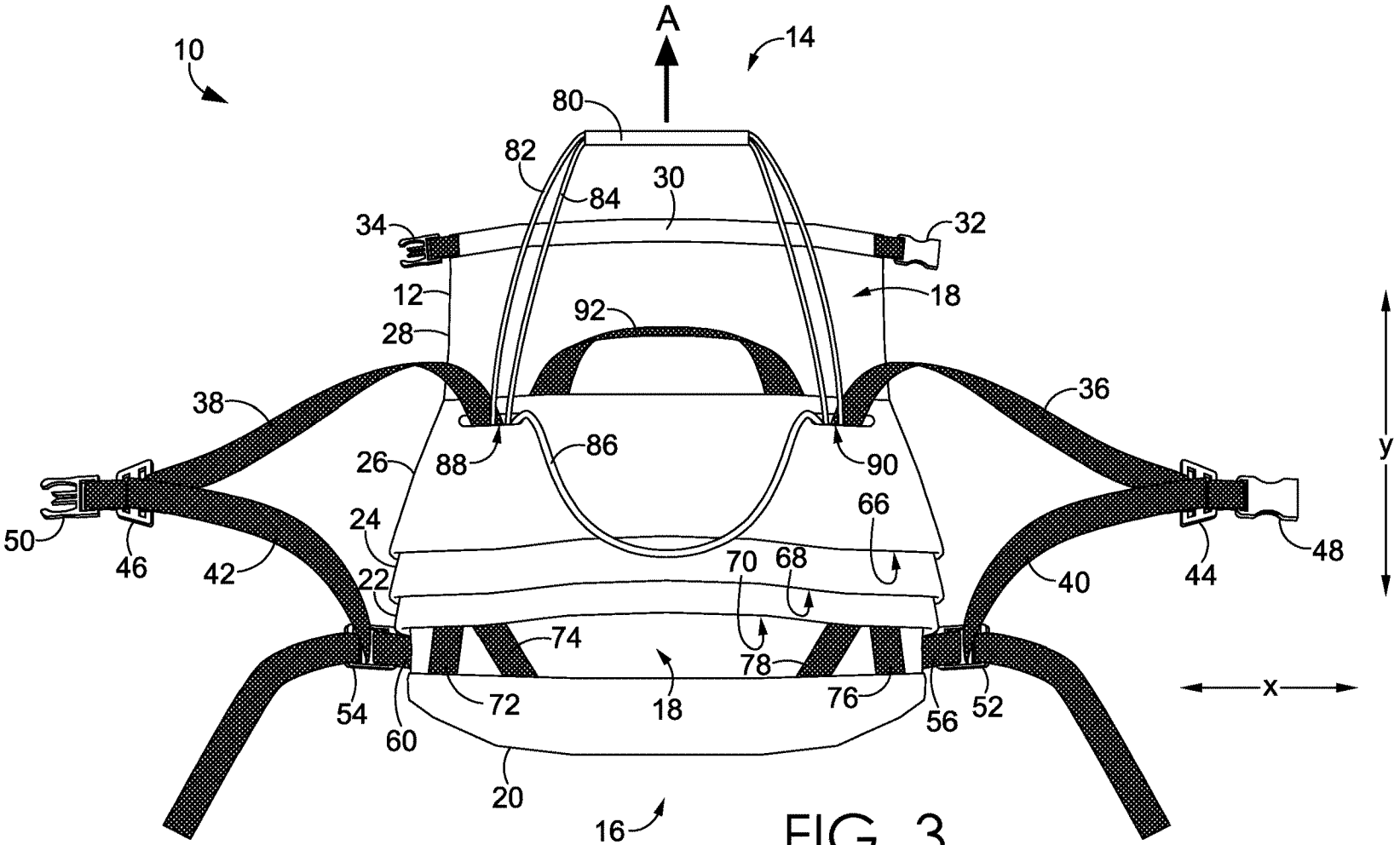
FIG. 3 depicts a back view of the compressible bag of FIG. 1 in a compressed position, in accordance with an example of present aspects.
Figure 4:
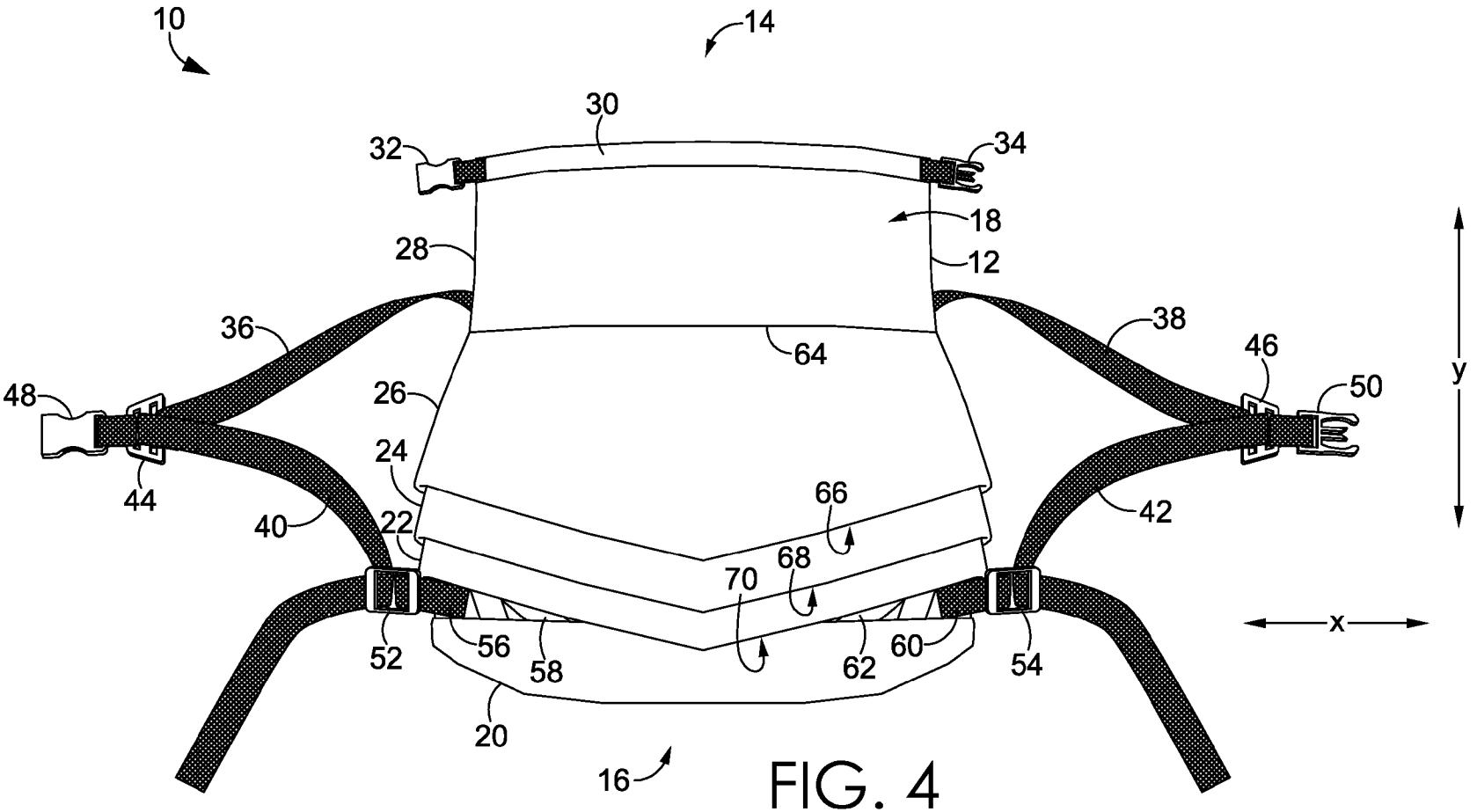
FIG. 4 depicts a front view of the compressible bag of FIG. 1 in a compressed position, in accordance with an example of present aspects.
Figure 5:
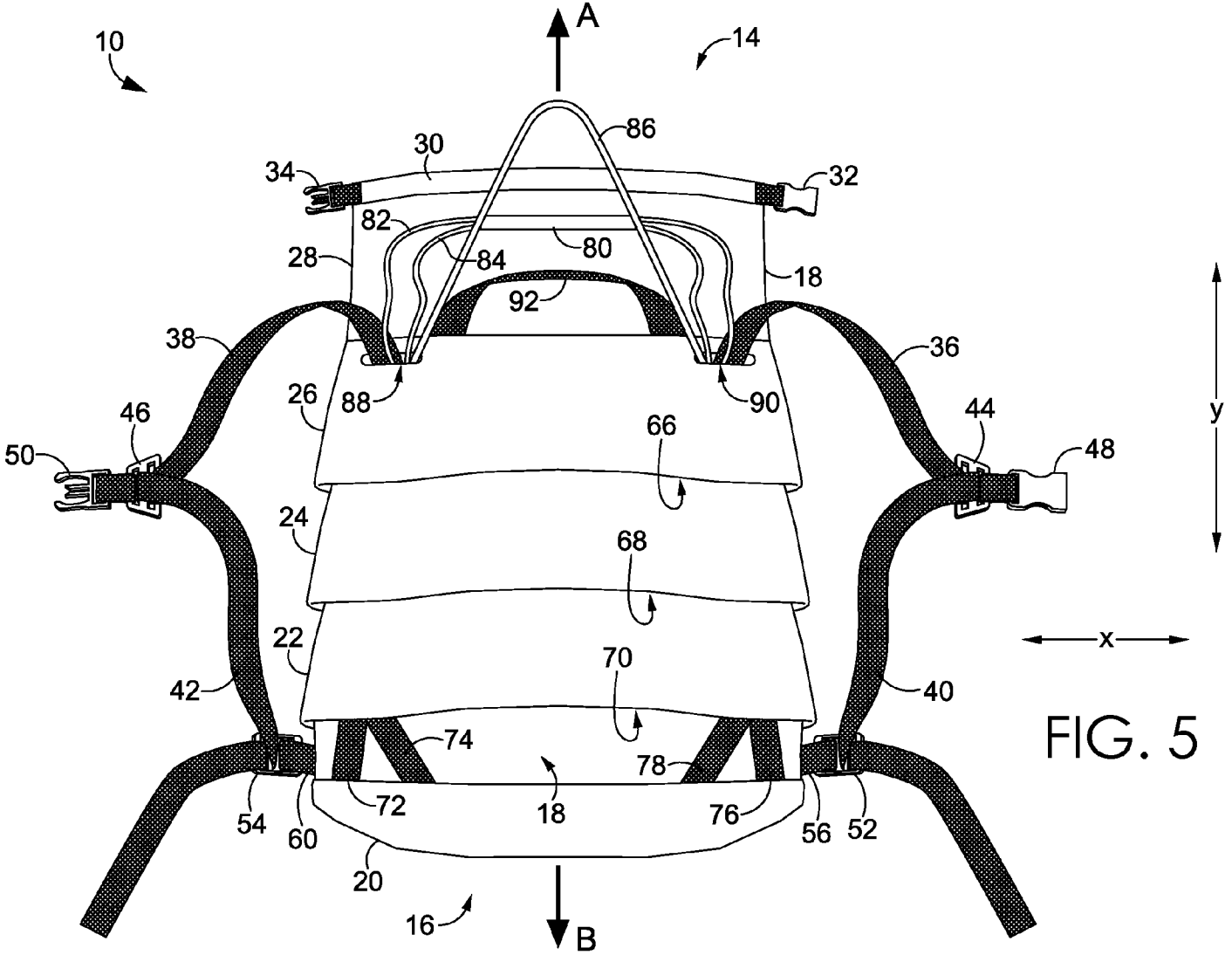
FIG. 5 depicts a back view of the compressible running bag of FIG. 1, moving from a compressed position to an expanded position, in accordance with an example of present aspects.
Figure 6:
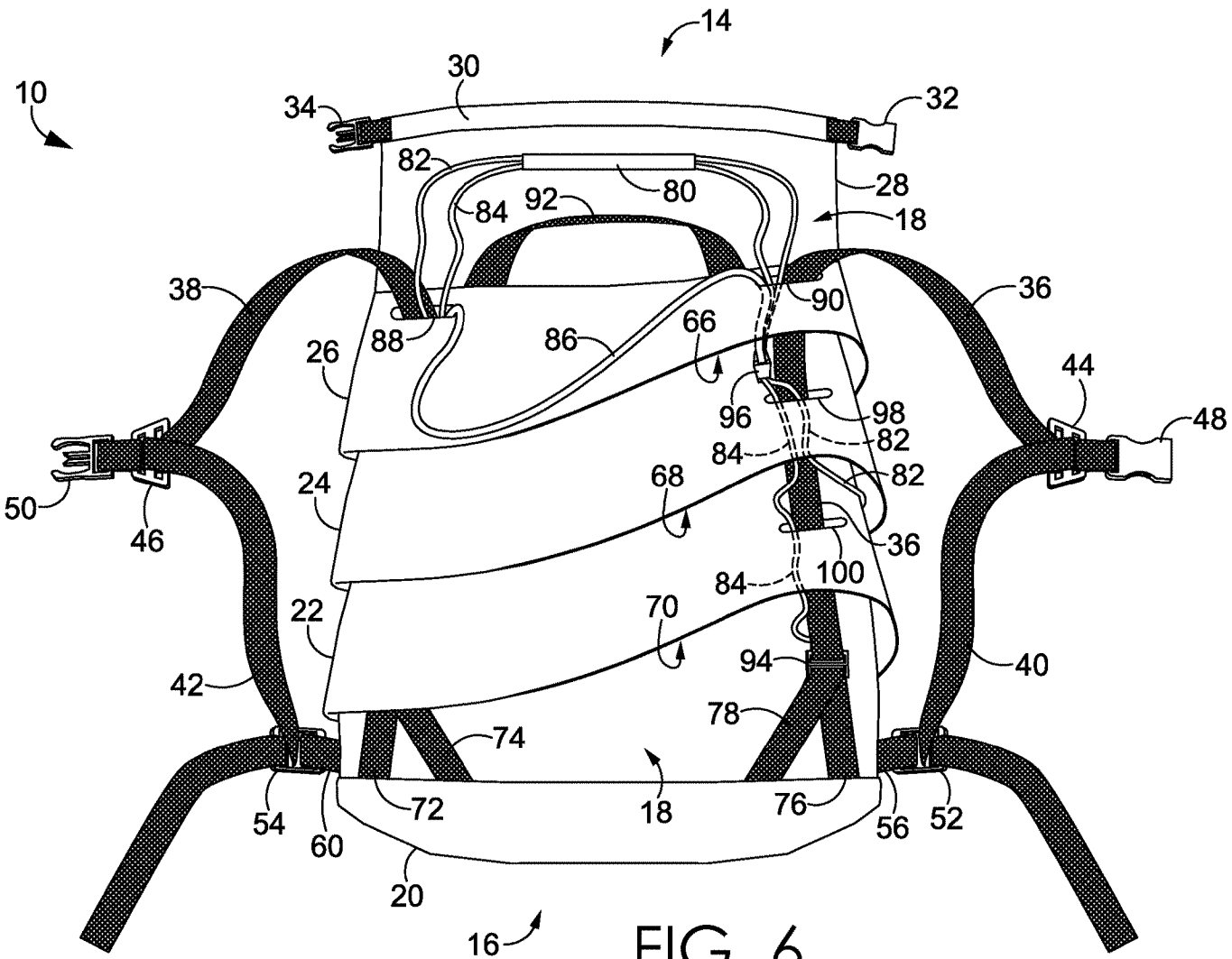
FIG. 6 depicts a back, perspective view of the compressible running bag of FIG. 1 with a series of raised, collapsible portions revealing a tethering channel for expanding and compressing the compressible running bag, in accordance with an example of present aspects.

At a high level, present aspects hereof are directed toward a compressible backpack having a central body comprising a bottom portion and at least one upper portion moveable relative to the bottom portion. The compressible backpack includes a first channel, a second channel, a third channel, and a fourth channel, wherein each of the first, second, third, and fourth channels comprises at least one aperture (e.g., apertures 88, 90, and 102) in the at least one upper portion. Additionally, a first tether (e.g., 84) is disposed within at least a portion of the first channel and at least a portion of the second channel, said first tether coupled to a first pair of anchors associated with the first and second channels. A second tether (e.g., 82) is disposed within at least a portion of the first channel, at least a portion of the second channel, at least a portion of a third channel, and at least a portion of a fourth channel, said second tether coupled to a second pair of anchors (e.g., 104 and 106 anchoring the tether 82 in relation to a channel having the aperture 102) associated with the third and fourth channels. In some aspects, a pair of locking mechanisms (e.g., locking mechanism 96 represents one locking mechanism on the right side of the bag in FIG. 6 and another locking mechanism on the left side in FIG. 6 is hidden from view under the flange of segment 26) are coupled to a locking release (e.g., 86), said locking mechanism (e.g., 96) configured to engage at least a portion of the first and second tethers.

In one exemplary aspect, a compressible bag includes an upper bag portion, a lower bag portion, and an intermediate bag portion. In aspects, the intermediate bag portion includes a plurality of compressible segments each having a flange and a cavity, said plurality of compressible segments comprising: a lower compressible segment adjacent said lower bag portion, an upper compressible segment adjacent said upper bag portion, a first channel comprising at least one aperture in at least one compressible segment of the plurality of compressible segments, and a second channel comprising at least one aperture in at least one compressible segment of the plurality of compressible segments. Additionally, the compressible bag includes at least one tether coupled to the lower bag portion, said at least one tether disposed within at least a portion of the first channel and at least a portion of the second channel; and at least one locking mechanism configured to engage the at least one tether, wherein when the bag is in an expanded position, the lower compressible segment is separated a first distance from the upper compressible segment, wherein when the bag is in a compressed position, the lower compressible segment is separated a second distance from the upper compressible segment, wherein the second distance is less than the first distance.

In further aspects, a compressible bag includes a bottom bag segment; a central bag segment adjacent the bottom bag segment, said central bag segment aligned along a vertical axis and comprising an interior bag cavity; a plurality of compressible bag flanges coupled to at least a portion of a circumference of the central bag segment, wherein each of the plurality of compressible bag flanges comprises a cavity between a bottom edge of each of the compressible bag flanges and the central bag segment; a first channel comprising at least one aperture in at least one of the plurality of compressible bag flanges; a second channel comprising at least one aperture in at least one of the plurality of compressible bag flanges; a first tether disposed within the first channel at a first end of the first tether, and disposed within the second channel at a second end of the first tether, wherein the first tether is coupled to a back side of the compressible bag; a second tether disposed within the first channel at a first end of the second tether, and disposed within the second channel at a second end of the second tether, wherein the second tether is coupled to a front side of the compressible bag; and a control mechanism coupled to the first tether and the second tether, wherein the control mechanism is configured to secure the compressible bag in a compressed position based on tensioning the first and second tethers.

Additional features of exemplary aspects are described below with reference to FIGS. 1-8B. In the front view of FIG. 1, the compressible bag 10 includes a bag body 12 having an upper end 14 and a lower end 16 aligned along a vertical y axis. The backpack body 12 may include a compartment 18 having an interior cavity configured to store one or more items. As further shown in the example of FIG. 1, the compressible bag 10 includes a bottom portion 20, a first compressible segment 22, a second compressible segment 24, a third compressible segment 26, and an upper segment 28 having an upper edge 30 that may be joined by closure features 32 and 34. The example compressible bag 10 further includes first and second upper straps 36 and 38, first and second lower straps 40 and 42, first and second strap positioners 44 and 46, first and second coupling mechanisms 48 and 50 configured to secure the compressible bag 10 for use as a backpack or other storage device.

Figure 7:
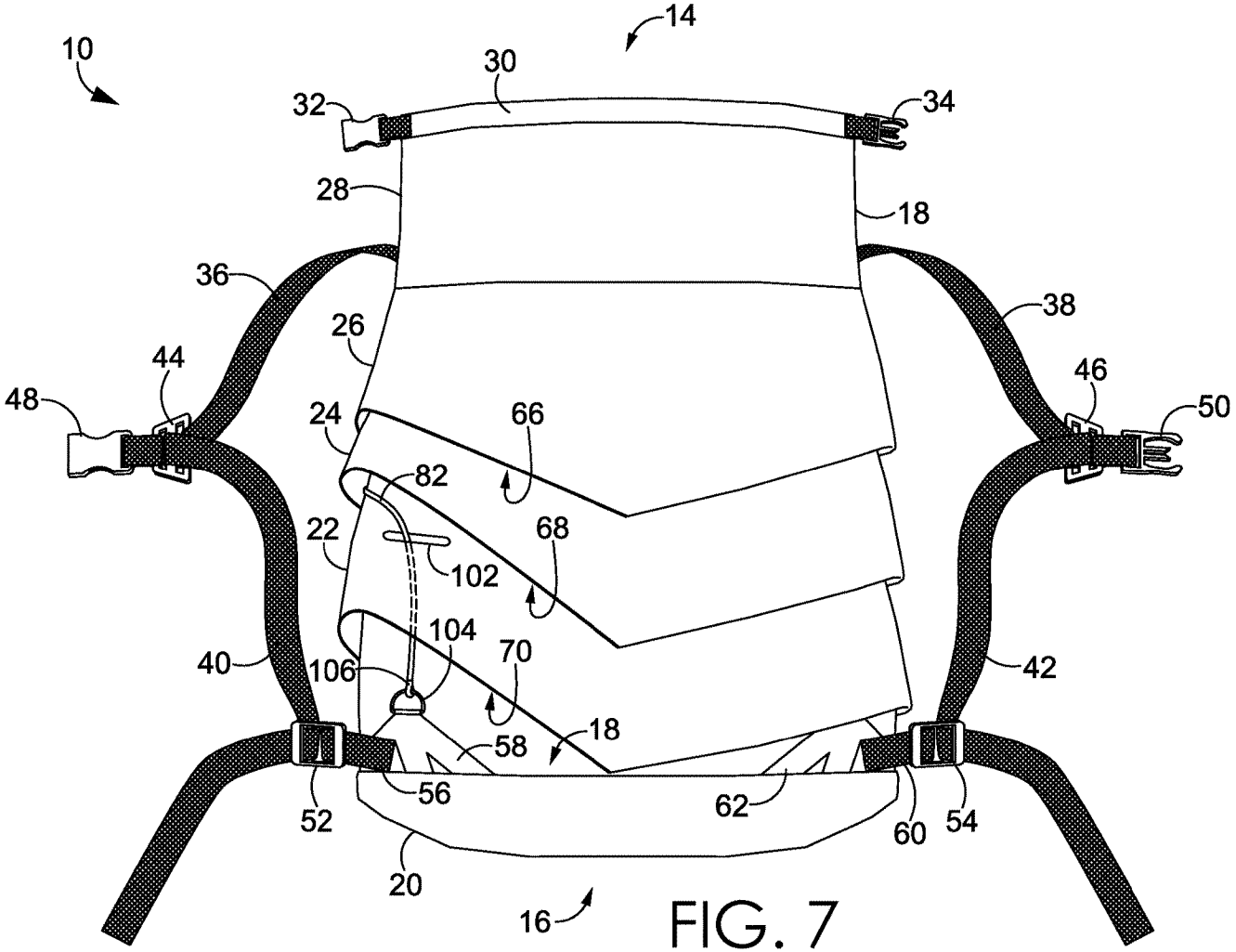
FIG. 7 depicts a front, perspective view of the compressible running bag of FIG. 1 with a series of raised, collapsible portions revealing a tethering channel for expanding and compressing the compressible running bag, in accordance with an example of present aspects.
Figure 8A:
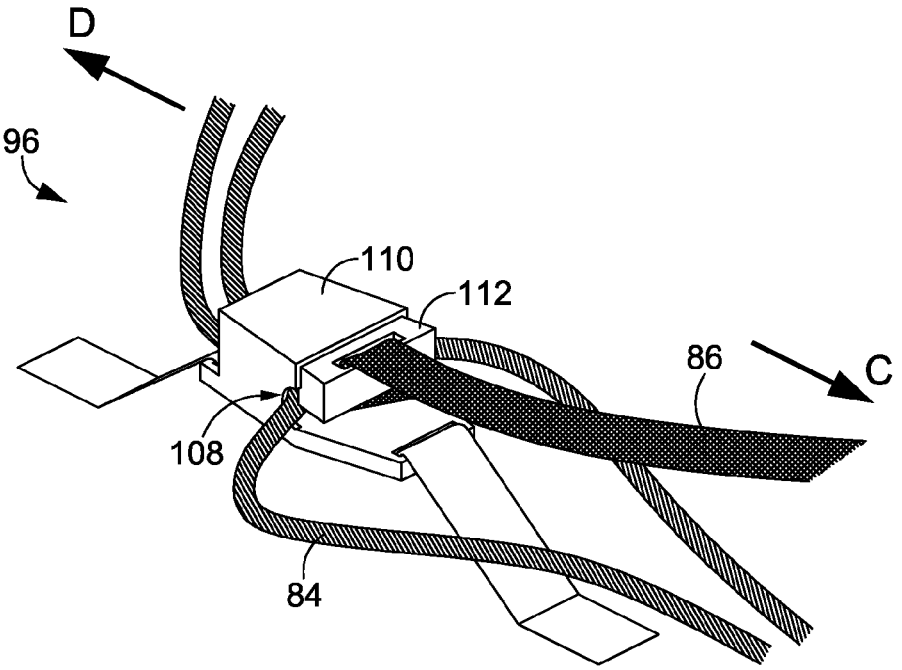
FIG. 8A depicts a side, perspective view of a control mechanism for controlling expansion and compression of the compressible running bag, in a closed position, in accordance with an example of present aspects.
Figure 8B:
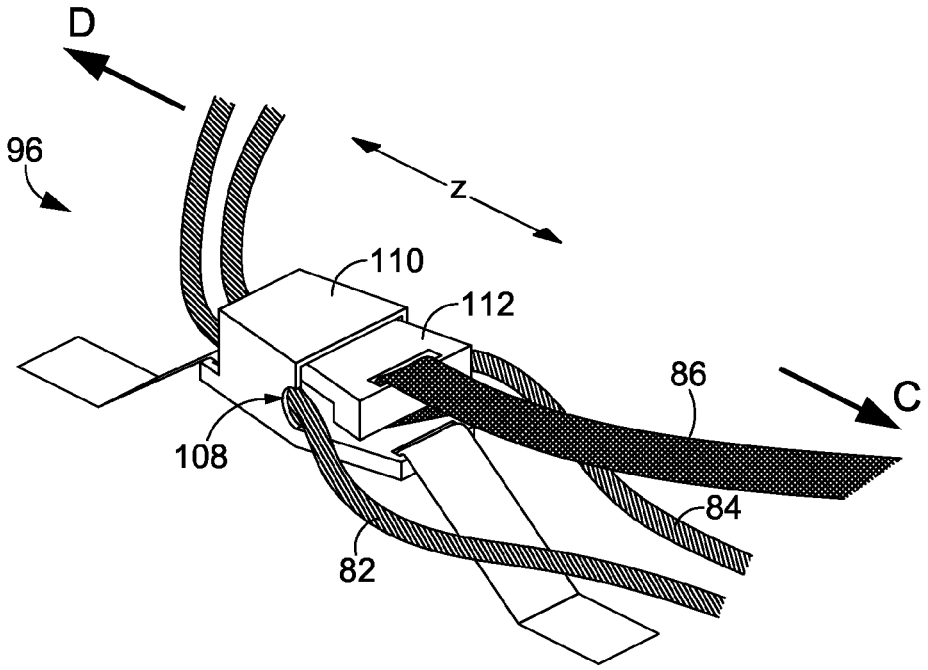
FIG. 8B depicts a side, perspective view of the control mechanism of FIG. 8A in an open position, in accordance with an example of present aspects.

Exemplary compressible bag 10 further includes first and second buckles 52 and 54 that couple the anchor straps 56 and 60 to anchors 58 and 60, a seam 64 between the upper segment 28 and the third compressible segment 26, and cavities 66, 68, and 70 beneath each of the compressible flanges, which function during compression of the compressible bag 10. As further depicted in FIG. 2, the compressible bag 10 includes anchor straps 72, 74, 76, and 78 (which attach to strap 36 by way of buckle 94), first tether 82, second tether 84, and locking release 86, grip handle 92, apertures 88, 90, 98, 100, and 102, and tether grip 80. In the compressed views of FIGS. 3-4, the compressible bag is shown having the tethers pulled in an upward direction A, away from the base of the bag, thereby compressing the flanges of each of the compressible portions of the bag into their adjacent cavities. Upon pulling the release 86, the locking mechanism 96, 108, 110, and 112 depicted in FIGS. 8A-8B permits the travel of each of the tethers in a downward direction B, expanding the compressible bag and extracting each flange from the adjacent cavity. In some aspects, a positioning of each of the tethers with respect to the bottom portion of the bag cavity and/or lower bag portion provides a consistent raising and lowering of the bottom of the bag, and corresponding compression and expansion of the compressible bag cavity. Additionally, based on the compression of adjacent segments of the bag flanges, the exterior of the bag remains solid, having minimized surface area while maintaining a vertical structure of the compressible bag along the vertical y axis. As shown in FIGS. 6-7, channel features on one or more portions of the compressible bag provide for a tracked expansion and contraction of the bag structure while utilizing the tensioning features of the tethers pulled by a user.

Present aspects hereof have been described in relation to particular examples, which are intended in all respects to be illustrative rather than restrictive. From the foregoing, it will be seen that the present aspects are well adapted to attain all the ends and objects set forth above, together with other advantages, which are obvious and inherent to the system and method. It will be understood that certain features and subcombinations are of utility and may be employed without reference to other features and subcombinations. This is contemplated by and is within the scope of the claims.

What is claimed is:

1. A compressible backpack comprising:

a central body comprising a bottom portion and at least one upper portion moveable relative to the bottom portion;

a first channel, a second channel, a third channel, and a fourth channel, wherein each of the first, second, third, and fourth channels comprises at least one aperture in the at least one upper portion;

a first tether disposed within at least a portion of the first channel and at least a portion of the second channel, said first tether coupled to a first pair of anchors associated with the first and second channels;

a second tether disposed within at least a portion of the first channel, at least a portion of the second channel, at least a portion of a third channel, and at least a portion of a fourth channel, said second tether coupled to a second pair of anchors associated with the third and fourth channels; and a pair of locking mechanisms coupled to a locking release, said locking mechanisms configured to engage at least a portion of the first and second tethers.

2. The backpack of claim 1, wherein the at least one upper portion comprises a first upper portion adjacent the bottom portion and a second upper portion adjacent the first upper portion.

3. The backpack of claim 2, wherein the first upper portion and the second upper portion are moveable relative to the bottom portion based on at least a portion of the first upper portion engaging a flange cavity of the second upper portion.

4. The backpack of claim 3, further comprising a third upper portion moveable relative to the bottom portion based on at least a portion of the second upper portion engaging a flange cavity of the third upper portion.

5. The backpack of claim 1, further comprising a first shoulder strap coupled to the central body, said first shoulder strap disposed within at least a portion of the first channel.

6. The backpack of claim 5, further comprising a second shoulder strap coupled to the central body, said second shoulder strap disposed within at least a portion of the second channel.

7. The backpack of claim 1, wherein the pair of locking mechanisms are configured to engage or disengage against the first and second tethers in association with upward and downward travel of the bottom portion.

8. A compressible bag comprising:

an upper bag portion;

a lower bag portion;

an intermediate bag portion comprising a plurality of compressible segments each having a flange and a cavity, said plurality of compressible segments comprising:

a lower compressible segment adjacent said lower bag portion, an upper compressible segment adjacent said upper bag portion, a first channel comprising at least one aperture in at least one compressible segment of the plurality of compressible segments, and a second channel comprising at least one aperture in at least one compressible segment of the plurality of compressible segments;

at least one tether coupled to the lower bag portion, said at least one tether disposed within at least a portion of the first channel and at least a portion of the second channel; and at least one locking mechanism configured to engage the at least one tether, wherein when the bag is in an expanded position, the lower compressible segment is separated a first distance from the upper compressible segment, wherein when the bag is in a compressed position, the lower compressible segment is separated a second distance from the upper compressible segment, wherein the second distance is less than the first distance.

9. The compressible bag of claim 8 further comprising a first shoulder strap associated with the first channel and a second shoulder strap associated with the second channel.

10. The compressible bag of claim 8 further comprising an interior cavity comprising an interior of at least a portion of the upper bag portion, the intermediate bag portion, and the lower bag portion.

11. The compressible bag of claim 10, wherein the interior cavity is accessible based on an opening of the upper bag portion, and further wherein the interior cavity comprises a first cavity depth when the compressible bag is in an expanded position, and a second cavity depth when the compressible bag is in a compressed position, wherein the first cavity depth is greater than the second cavity depth.

12. The compressible bag of claim 8, wherein the at least one tether comprises:

a first tether disposed within at least a portion of the first channel and at least a portion of the second channel; and a second tether disposed within at least a portion of the first channel and at least a portion of the second channel, wherein the first tether is coupled to the lower bag portion on a back side of the compressible bag, and wherein the second tether is coupled to the lower bag portion on a front side of the compressible bag.

13. The compressible bag of claim 12, wherein the first channel and the second channel are positioned on the back side of the compressible bag.

14. The compressible bag of claim 13, further comprising a third channel and a fourth channel positioned on the front side of the compressible bag, wherein the second tether is disposed within at least a portion of the third channel and the fourth channel.

15. The compressible bag of claim 12, wherein the at least one locking mechanism comprises a pair of locking mechanisms disposed within the cavity of the upper compressible segment.

16. The compressible bag of claim 12, wherein the intermediate bag portion comprises at least one middle compressible segment between the lower compressible segment and the upper compressible segment, said at least one middle compressible segment comprising a flange and a cavity.

17. A compressible bag comprising:

a bottom bag segment;

a central bag segment adjacent the bottom bag segment, said central bag segment aligned along a vertical axis and comprising an interior bag cavity;

a plurality of compressible bag flanges coupled to at least a portion of a circumference of the central bag segment, wherein each of the plurality of compressible bag flanges comprises a cavity between a bottom edge of each of the compressible bag flanges and the central bag segment;

a first channel comprising at least one aperture in at least one of the plurality of compressible bag flanges;

a second channel comprising at least one aperture in at least one of the plurality of compressible bag flanges;

a first tether disposed within the first channel at a first end of the first tether, and disposed within the second channel at a second end of the first tether, wherein the first tether is coupled to a back side of the compressible bag;

a second tether disposed within the first channel at a first end of the second tether, and disposed within the second channel at a second end of the second tether, wherein the second tether is coupled to a front side of the compressible bag; and a locking mechanism coupled to the first tether and the second tether, wherein the locking mechanism is configured to secure the compressible bag in a compressed position based on tensioning the first and second tethers.

18. The compressible bag of claim 17, wherein the first channel and the second channel are positioned on the back side of the compressible bag.

19. The compressible bag of claim 18, further comprising a third channel and a fourth channel positioned on the front side of the compressible bag, wherein the second tether is disposed within the third channel at a first end of the second tether, and wherein the second tether is disposed within the fourth channel at a second end of the second tether.

20. The compressible bag of claim 17, wherein each cavity of the plurality of compressible bag flanges encloses at least a portion of an upper edge of an adjacent compressible bag flange when the compressible bag is in a compressed position.

* * * * *